United States Patent [19]

Santinelli

[11] 4,394,099

[45] Jul. 19, 1983

[54] PLASTIC LENS CONTOUR CUTTING MACHINE

[75] Inventor: Emil Santinelli, Carmel, N.Y.

[73] Assignee: Lemay Corporation, Carmel, N.Y.

[21] Appl. No.: 227,225

[22] Filed: Jan. 22, 1981

[51] Int. Cl.[3] ..... B23C 1/18; B24B 9/14

[52] U.S. Cl. ..... 409/104; 51/101 LG; 409/111; 409/112; 409/122

[58] Field of Search ..... 409/104, 111, 112, 122, 409/123; 51/101 LG, 105 LG, 127, 284 R

[56] References Cited

U.S. PATENT DOCUMENTS

| | | | |
|---|---|---|---|
| 2,333,064 | 10/1943 | Williams | 409/104 |
| 3,555,739 | 1/1971 | Novak | 409/122 X |
| 3,786,600 | 1/1974 | Bloxsom | 409/122 X |
| 3,828,648 | 8/1974 | Geula | 51/101 LG |
| 4,157,636 | 6/1979 | Wrigglesworth | 51/101 LG |
| 4,191,501 | 3/1980 | Sinklier | 409/104 |
| 4,195,445 | 4/1980 | Bardonnet | 51/101 LG |
| 4,203,259 | 5/1980 | Haddock | 51/106 LG X |
| 4,233,784 | 11/1980 | Loreto | 51/106 LG X |

FOREIGN PATENT DOCUMENTS

| | | | |
|---|---|---|---|
| 2831482 | 2/1979 | Fed. Rep. of Germany | 51/101 LG |
| 2456304 | 1/1981 | France | 51/101 LG |
| 1356208 | 6/1974 | United Kingdom | 51/101 LG |
| 2041800 | 9/1980 | United Kingdom | 51/101 LG |

*Primary Examiner*—William R. Briggs
*Attorney, Agent, or Firm*—Anthony J. Casella

[57] ABSTRACT

In a plastic lens grinding machine of the type having a head mounted on a base and adapted to carry a lens pattern and a plastic lens having a base curvature, the head is capable of movement parallel to the axis of rotation of the plastic lens. A carriage is mounted on the base and is movable perpendicular to said axis of rotation, with the carriage having an improved rotatable cutter with a cutting edge made of a metal of high hardness and adapted to be rotated at high speed in order to be self-coolant. A hydraulic damper is mounted on the carriage and connected to the base for regulating the gravitational movement of the carriage towards the axis of rotation of the plastic lens, thus regulating the engagement of the metallic cutter blade with the periphery of the plastic lens. An improved bevel aligning device is provided having a base curve cam connected to the head and a cam tracer connected to the carriage, with the cam having a surface forming the same base curvature as the plastic lens. The tracer is in bearing contact with the surface of the cam and effects a movement of the head with the lens in a first direction to a position that aligns the center of the lens with the beveling device. The bevel aligning device further includes a biasing spring connected to the head and to the base for effecting movement of the head in a circular direction resulting in bearing contact of the surface of the cam against the tracer. By this arrangement, when the lens and the lens pattern are rotated, with the cutter being rotated at high speed, the carriage moves toward the axis of rotation thereby effecting an engagement of the cutter with the plastic lens periphery. The cutter cuts and edges the plastic lens while the beveling device simultaneously forms a bevel at the center of the periphery of the plastic lens.

12 Claims, 16 Drawing Figures

PLASTIC LENS CONTOUR CUTTING MACHINE

BACKGROUND OF THE INVENTION

The subject invention relates to an improved machine for edging and beveling the periphery of plastic lenses wherein a high speed, self-cooled cutter does not require a liquid cutter coolant, and wherein a bevel aligning means automatically positions the cutter beveling notch at the desired position on the periphery of the lens during the cutting process. In addition, the subject invention includes a hydraulic cylinder that regulates the pressure of the cutter against the plastic lens by dampening the movement of the carriage that carries the cutter. The subject invention also includes a pressurized air cylinder that moves the carriage and the cutter away from the lens upon completion of the edging and beveling process.

Lenses are edged and beveled from blanks for insertion into a wide variety of frame contours other than round, such as oval and octagonal. Glass lenses at one time were the only type used, but in recent years plastic lenses have increasingly come into use. In most of the prior art, a diamond cutter, which is used to contour glass lenses, is also used to shape the new plastic lenses. Because of the heat generated by the diamond grinding wheel during the cutting process, a fluid coolant has been required. Problems associated with liquid cooling, typically leakage, corrosion, contaminants in the coolant resulting in overheating, and the necessity to change the coolant every day, are all present.

Lenses are contoured according to lens patterns supplied by the manufacturer of the lenses. A lens pattern in fact acts as a cam that, in turn, acts against a follower that effects a cutting of the lens in accordance with the pattern cam. The manufacturer also directs lens sizes, and, in addition to the contour of the periphery, the size of the lens must be introduced into the lens producing process.

In general, two types of lenses are produced, prescription lenses and sunglass lenses. Sunglass lenses are usually flat, while prescription lenses have various lens curvatures and thicknesses depending on the magnification required and other prescription necessities. A bevel must be formed around the periphery of lenses that is adapted to fit into the groove present around the inner side of eyeglass frames. This bevel must be formed either at the center of the lens periphery or at a specified distance from the front or back of the lens. Prescription lenses, for example, are often thick, and the bevel must be formed toward the front of the lens for aesthetic purposes.

In the prior art, the operator generally sizes down the lens blank in two or three stages so as to ensure that the position of the crown of the bevel is positioned correctly. This is a time-consuming process, and not only calls for constant operator attention, but it calls for a skilled operator.

Lens cutting machines in the prior art includes a movable head portion that carries a lens to be contoured and a lens pattern and a movable carriage portion that carries a lens cutter. One type of design has the head with the lens movable laterally relative to the carriage for beveling alignment of the lens relative to the cutter, and the carriage movable perpendicularly to the lateral movement of the head, or floating, for cutting and contouring the lens in accordance with the pattern. Another type has a head capable of being floated relative to the carriage and the carriage movable laterally. Variations on these designs are known.

An example of prior art disclosing a special cutting process for plastic lenses can be found in U.S. Pat. No. 4,191,501 issued Mar. 4, 1980 to Sinklier et al. The Sinklier patent discloses a cutting machine particularly directed to cutting and edging plastic lenses. The Sinklier patent provides a lens cutter that makes a rough cut of the lens by cutting plastic away from the periphery of the lens blank in a single radial bite rather than grinding away the periphery. It is the design of the machine itself that directs the cutter toward a single deep bite rather than the design of the cutter. The patent to Sinklier also discloses a means for mounting the lens cutter for free longitudinal, or horizontal, movement so that in a subsequent step after the rough cut, the cutter can automatically follow the curvature of the lens during additional rotation in order to provide a finishing cut and bevel. This horizontal movement is free floating rather than guided.

Other prior art cutting machines are disclosed in U.S. Pat. No. 3,786,600 issued Jan. 22, 1974 to Bloxom; and U.S. Pat. No. 4,203,259, issued May 20, 1980 to Haddock. The cited patents disclose various types of lens and lens pattern contouring devices.

Accordingly, it is an object of the subject invention to provide a new and improved lens edging machine that eliminates the need for liquid cooling of the lens cutter.

It is a further object of the subject invention to provide a new and improved lens edging machine that provides a high speed cutter that is capable of edging lenses at a high rate of production.

It is a still further object of the subject invention to provide a new and improved lens edging machine wherein a bevel aligning means is provided for automatically aligning the crown of the bevel to a selected position around the periphery of the lens.

It is still another object of the subject invention to provide a hydraulic dampening means for regulating the movement of the cutter against the lens.

It is still another object of the subject invention to provide a pressurized air means for moving the cutter away from the periphery of the lens when the edging and beveling operation has been completed.

SUMMARY OF THE INVENTION

In accordance with these and many other objects, the subject invention provides a new and improved machine for cutting, edging, contouring, and beveling the periphery of a plastic lens. The new and improved machine is of the type having: a head mounted on a base and carrying a lens pattern and a plastic lens to be cut having a base curvature, the lens pattern and the plastic lens being rotatable about a common axis, with the head being capable of movement substantially parallel to the axis; a carriage mounted on said base and having a pattern follower in bearing contact with the lens pattern; and a rotatable cutter with a cutting edge capable of engaging the periphery of the plastic lens, the cutting edge forming a beveling means, with the carriage being capable of substantially perpendicular movement toward and away from the axis. The movement of the carriage is by gravitational force toward the axis effecting an engagement of the cutter with the periphery of the lens, while the movement away from the axis is governed by a pneumatic actuator.

More specifically, the new and improved machine provides a cutter having a cutting edge of a metal of high hardness and being capable of being rotated at high speed and being self-cooled by the movement of air created by its own rotation. A hydraulic dampening means is mounted on the carriage and connected to the base, the dampening means being capable of regulating the gravitational movement of the carriage with the cutter toward the axis of the lens and of regulating the engagement of the cutter with the periphery of the lens.

In addition, bevel aligning means is provided, including a base curve cam means connected to the head and a cam tracing means connected to the carriage. The cam means has a surface forming the same base curvature as the lens, and the cam tracing means is capable of being in bearing contact with the base curve cam surface and of effecting a movement of the head carrying the lens in a first direction to a position that aligns the center of or any selected position on the lens with the bevel means formed by the cutter. The bevel aligning means includes biasing means connected to the head and the base, and effects a movement of the head in a second direction that results in bearing contact of the surface of the cam means against the tracing means.

Further, the surface of the base curve cam means includes a plurality of discrete sectors, each of the sectors having a different base curvature surface. The cam means is capable of being rotated to effect bearing alignment between the surface of any selected sector and said tracing means. Hence, when the selected sector has a surface forming the same base curvature as the base curvature of the lens, the tracing means is capable of effecting a movement of the head with the lens in the first direction to a position that aligns the center of the lens with the beveling means.

In operation, a motor mounted on the head simultaneously rotates the lens to be cut and the lens pattern, and a high-speed motor mounted on the carriage rotates the lens cutter at a high speed. The gravitational movement of the carriage and of the cutter toward the rotating lens is regulated by the hydraulic dampening means so that the lens is edged and beveled automatically. At such time, the bevel aligning means automaterially and simultaneously forms the crown of the bevel at the center, or any selected position, around the entire periphery of the lens.

The pressurized air cylinder means moves the carriage away from the head and the cutter away from the lens when the lens edging and beveling operation has been completed.

Further objects and advantages of the subject invention will become apparent from the following detailed description taken in conjunction with the drawings in which:

DESCRIPTION OF THE PREFERRED EMBODIMENT

Figure 1:
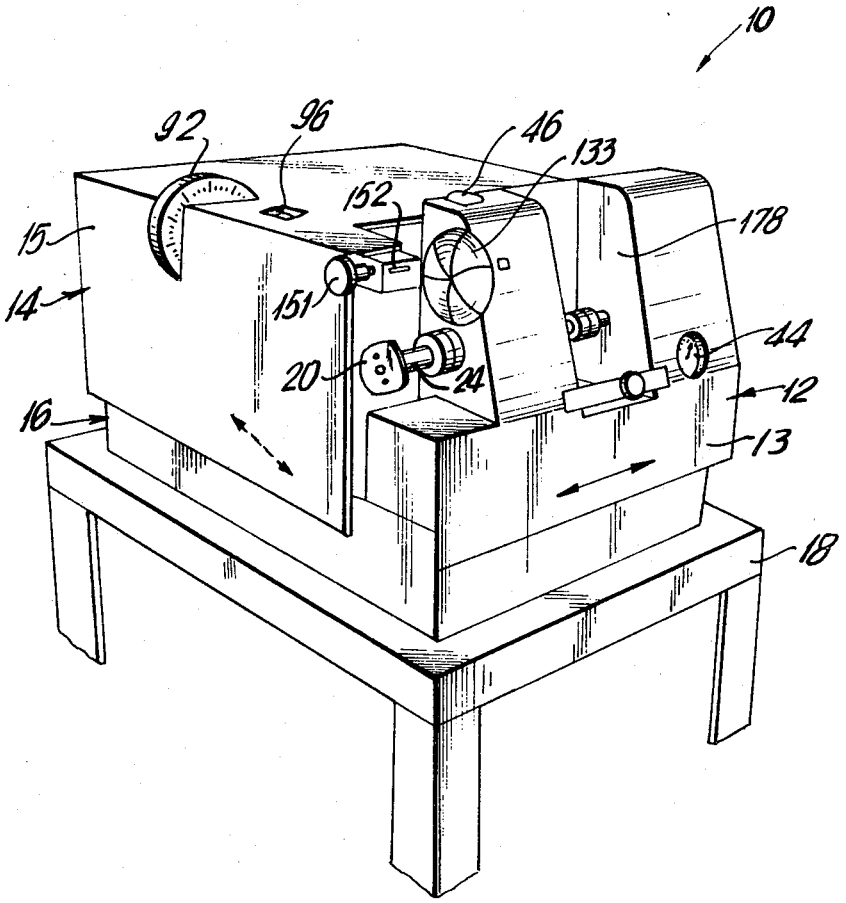
FIG. 1 is a perspective view of the new and improved lens edging machine of the subject invention.

Referring to FIG. 1, the new and improved machine 10 for cutting, edging, contouring, and beveling the periphery of a lens is illustrated in a general perspective view. In general the machine 10 is of the type having a head 12 and a carriage 14 each slidably mounted on base member 16, which in turn is usually placed on a table 18. The movement of carriage 14 is substantially perpendicular to the movement of head 12. Head 12 is shown with protective cover 13 and the carriage 14 with protective cover 15.

Figure 2:
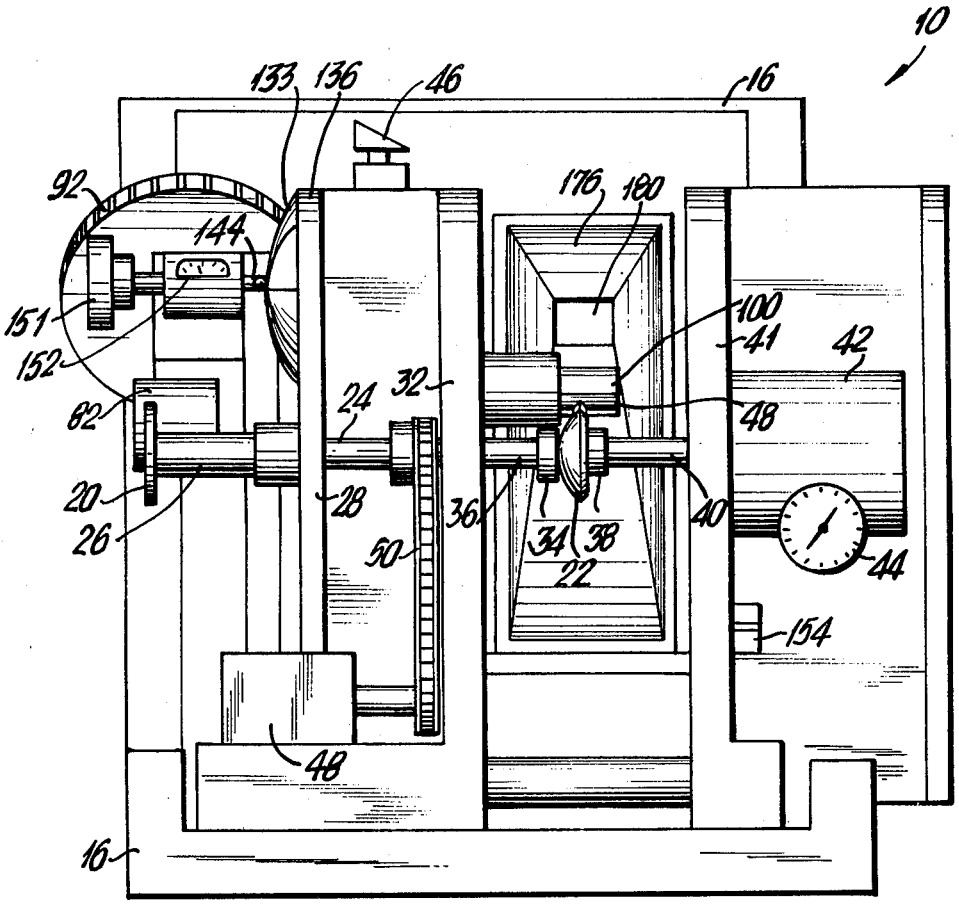
FIG. 2 is a front elevational view of the subject invention with the cover removed.
Figure 6:
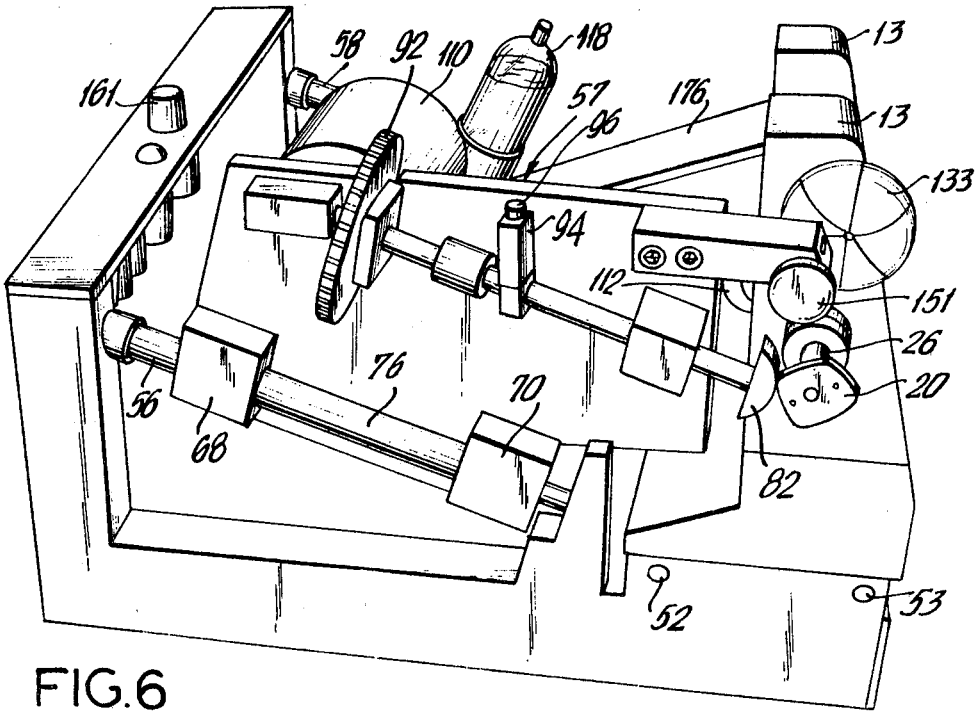
FIG. 6 is a perspective view of the lens cutting machine as viewed generally from the left side.
Figure 7:
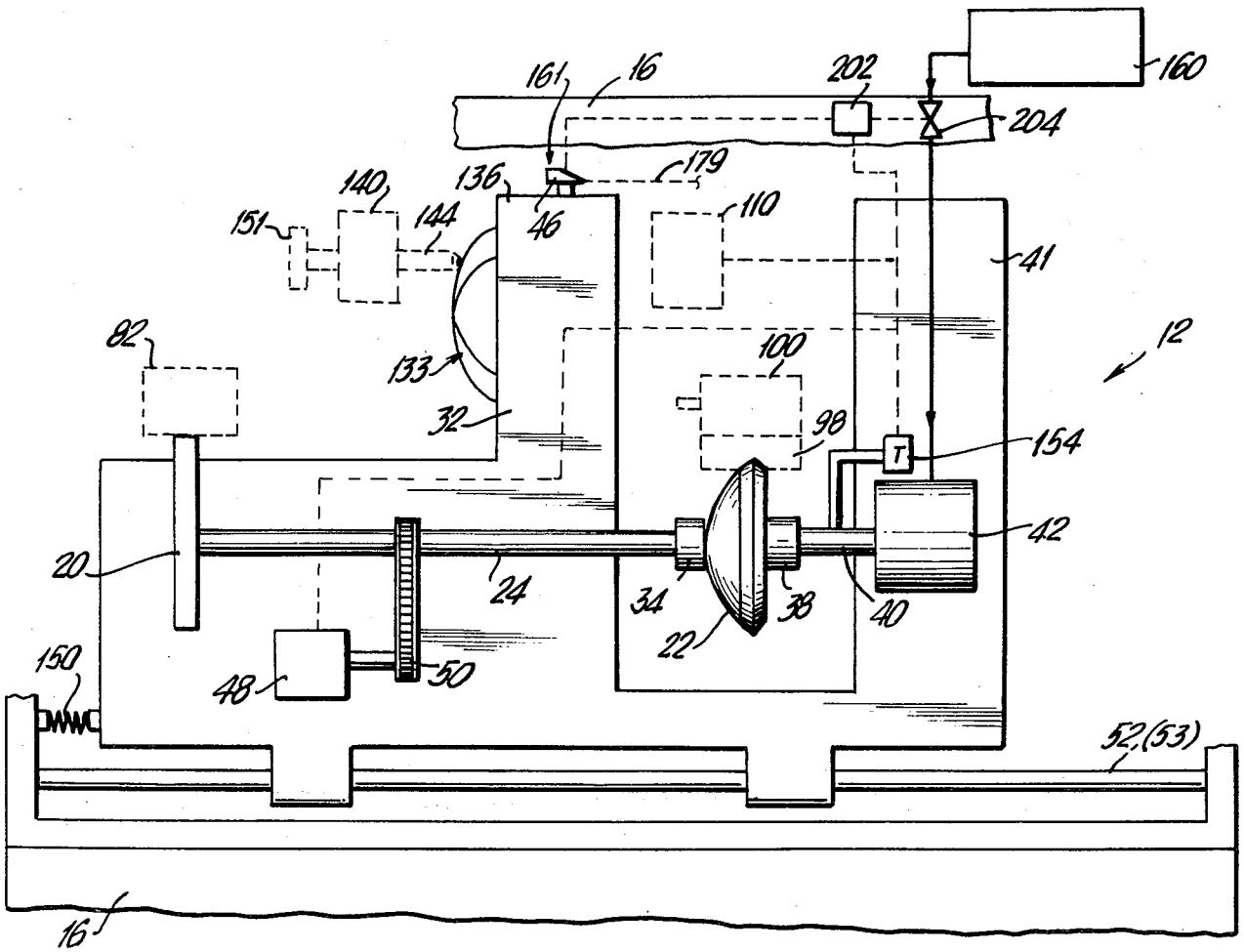
FIG. 7 is a schematic view of the head of the subject invention including essential features and selected carriage elements in imaginary lines.

Proceeding first with the description of head 14, reference is made to the frontal view of FIG. 2, the perspective view of FIG. 6, and the schematic view of FIG. 7. Head 12 carries lens pattern 20 and plastic lens 22, each rotatably mounted about axis 24. The operator has selected pattern 20 in accordance with the particular contour or configuration of the lens to be shaped. Patterns are generally made of plastic, or, in the event of high production usage, of flat metal. Pattern 20, which in fact acts as a cam, is mounted on pattern holder 26, which in turn is attached to rotatable axis 24. Axis 24 is rotatably supported at head support 28 and left vertical frame 32 on bearings at each support.

Lens chuck 34 is mounted on one end of axis 24 in the lens cutting area of the central portion of head 12 at the end of spindle 36, which is supported by left vertical frame 32. Lens chuck 38 is rotatably mounted on one end of axle 40, which is slidably mounted on right vertical frame 41. The opposite end of axis 40 is slidably connected to chuck compressed air cylinder 42. Axis 40 is unconnected to but has substantially the same axis as axis 24. An external source of compressed air such as compressor 160 (FIGS. 7 and 8) supplies compressed air to chuck cylinder 42. Air cylinder pressure gauge 44 is connected to chuck air cylinder 42 and mounted to the front of machine 10 as shown in FIGS. 1 and 2. Control means for chuck cylinder 12 is disclosed in relation to air compressor 160 later in the description. Pressure adjuster 161 is shown mounted on the rear of base 16 in FIG. 6.

Opposing chucks 34 and 38 generally are equipped with a rubber pad on one chuck and a felt pad on the other chuck. The operator mounts the convex portion 25 of lens 22, that is, the curved portion of a non-flat lens is selected for edging, against left chuck 34 and the concave portion against chuck 38. Operation of chuck/-fan rocker switch 46 causes an electrical signal to be sent to solenoid pressurizer 202 operating valve 204 (both mounted on the rear of base 16) to chuck air cylinder 42, which is then activated to slide axis 40 with chuck 38 towards chuck 34. Lens 22 is thereupon pressured between the two chucks and is ready for the edging process. Chuck/fan rocker switch 46 also sends a signal 179 to start and stop carriage fan 180, which is discussed below in relation to the evacuation of plastic chips and dust particles created during the lens cutting process.

Lens 22 and pattern 20 are then activated for rotation by starting head motor 48, which is mounted on head 12. Chain drive belt 50 (FIGS. 2 and 17) connected at one end to motor 48 and at the other end to axis 24, slowly rotates the lens and the pattern. Actuation of motors 48 and belt 50 will be discussed below in relation to timer cam 154.

As shown on the schematic representation of FIG. 7, head 12 is slidably mounted on guide means, preferably two parallel steel rails 52 and 53, mounted on base member 16. The ends of the steel rails are indicated on the open perspective drawing of FIG. 6. The rails are oriented so as to allow movement of head 12 substantially parallel to axis 24 and axis 40.

Other features related to head 12 will be described below in relation to bevel aligning means 132.

Figure 3:
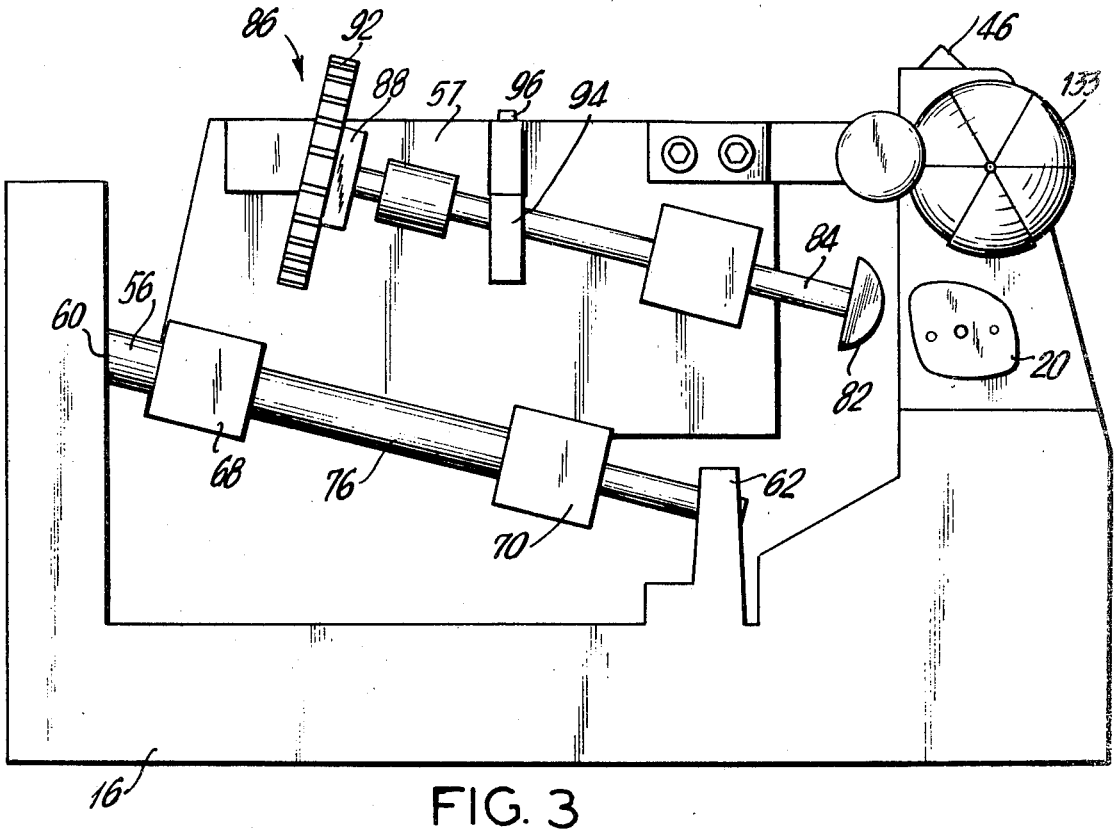
FIG. 3 is a left side elevational view of the subject invention with the cover removed.
Figure 4:
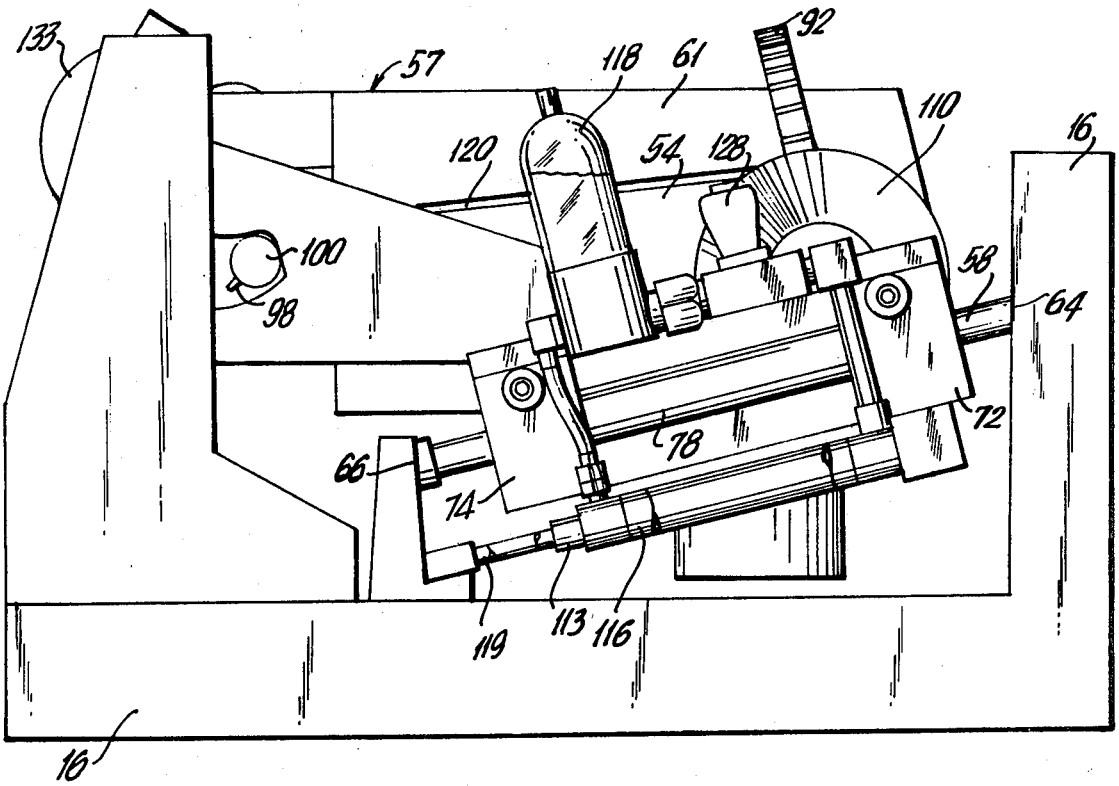
FIG. 4 is a right side elevational view of the subject invention with the cover removed.

Proceeding with a description of carriage 14, reference is made to FIGS. 2, 3, 4, 5, 6, 8 and 15, which illustrate various views of the carriage or its mechanisms. Carriage 12 includes a base plate and three vertical mounting members connected to the plate, namely left end vertical mounting member 57, middle vertical mounting member 59, and right end vertical mounting member 61. The methods of mounting are preferred embodiments only and can vary. Carriage 12 is slidably mounted on guide means, preferably two parallel support rods or rails 56 and 58, which are connected at each of their ends to base member 16. Rails 56 and 58 are indicated in FIGS. 3 and 6, and rail 58 is shown in FIG. 4. Rail 56 is connected to base 16 at points 60 and 62 and rail 58 is connected to base 16 at points 64 and 66. It is noted that rear connecting points 60 and 64 are elevated relative to points 62 and 66. The approximate angle of elevation of carriage plate 55 relative to the horizontal is preferably about 27°, but this angle may vary according to the total weight of the carriage and the equipment the carriage in fact will carry. It is critical to the operation of cutting machine 10 that the movement of carriage 14 on rails 56 and 58 be substantially perpendicular to the lateral movement of head 12 on guide rails 52 and 53, that is, perpendicular to axis 24 and axis 40. Carriage 14 is actually mounted on the rails via bearings contained in bearing housings 68 and 70 on rail 56 and bearing housings 72 and 74 on rail 58. Bar 76 connects housings 68 and 70 and bar 78 connects housings 72 and 74. Housings 68 and 70 and connecting bar 76 are affixed to carriage left vertical mounting member 57 and housings 72 and 74 and connecting bar 78 are affixed to right vertical mounting member 61.

Pattern follower 82 is mounted on carrier 14 and bears against pattern cam 20 by way of the gravitational shifting of the carrier from its rear position towards elevated connecting points 60 and 64 to its forward position towards connecting points 62 and 66. Follower 82 is connected to one end of connecting rod 84 and sizing mechanism 86 is connected to the other end of the rod. Mechanism 86 is affixed to carriage left vertical mounting member 57. As lens pattern 20 is rotated, follower 82 is continuously pressed against the surface of the rotating pattern by the gravitational pull downwards of carrier 14 on its guide means. When the pattern is irregular in peripheral configuration, that is, it is not round, the pattern will press against the follower, thus forcing the follower and the carriage upwards at high points in the pattern contour. The carrier thus floats upwards and downwards during pattern rotation.

Follower 82 is connected via rod 84 to major sizing dial mechanism 86, which in turn is controlled by major sizing dial control 92. Operation of dial 92 shortens or lengthens rod 84 via mechanism 86. Minor adjustment is accomplished at minor sizing mechanism 94 and controller 96. Major adjustment is measured in units of a full millimeter and minor adjustment in units of a tenth of a millimeter. For example, if the rod is to be adjusted to accomplish a 55.7 millimeter lens, the major adjustment is operated to a 55 reading and the minor adjustment to a 7 reading.

Figure 10:
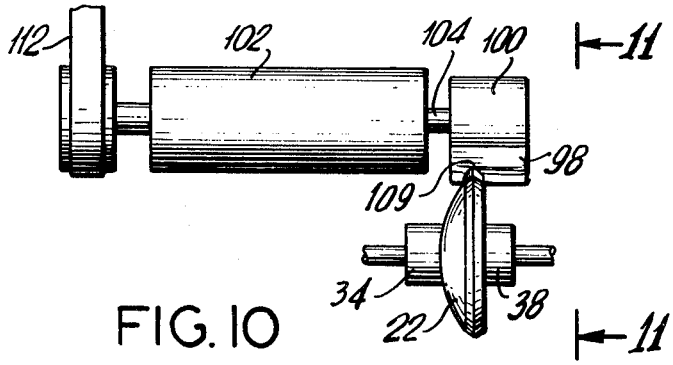
FIG. 10 is a detailed view of the cutter, lens, and spindle of the subject invention.
Figure 11:
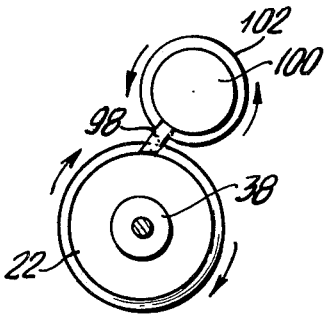
FIG. 11 is a side view taken along the line 11—11 in FIG. 10.

In accordance with the subject invention, cutter 98 is affixed to rotatable hub 100, which in turn is connected to spindle 102 via hub axis 104, as illustrated in FIGS. 2, 10, and 11. Spindle 102 is mounted to carriage 14 at middle vertical mounting member 59, which is affixed to carriage plate 55. Cutter 98 has carbide cutting edge 106 with V-shaped beveling notch 108. Notch 108 is aligned to be in bearing contact with lens periphery 23 when carriage 14 is free to ride gravitationally downward. Cutter 98 is rotated via spindle 102 and hub 100 by main motor 110, which is mounted on the rear of carriage plate 55, as illustrated in the preferred embodiments of FIGS. 4, 5, 6, and 8. Motor 110 is capable of rotating hub 100 and cutter 98 at high speed, preferably at approximately 10,000 revolutions per minute, via drive pulley 112, which is connected to the motor at one end and to hub axis 104 at the opposite end. The cutting blade (preferably of high hardness metal) of the cutter heats as it cuts and edges the lens as it rotates. The heat of the blade is cooled, however, by the rapid movement of the air generated by its own rotation. The necessity of cooling the blade by an external liquid source is thus avoided. As shown in FIG. 10 and 11, hub 100 and cutter 98 are rotated in a counterclockwise direction when viewed from the right, while lens 22 rotates in a clockwise direction. When viewed from the front, cutter 98 rotates downward and lens 22 rotates upward.

Figure 12:
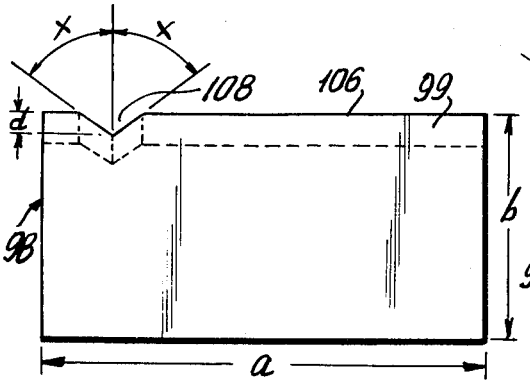
FIG. 12 is a detailed view of the cutter of the subject invention with a single bevel forming notch.
Figure 13:
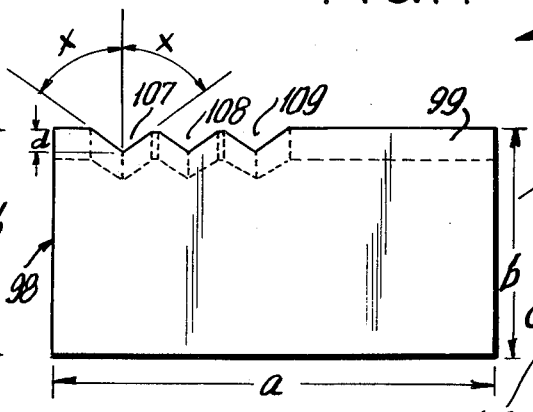
FIG. 13 is a detailed view of the cutter of the present invention with three bevel forming notches.
Figure 14:
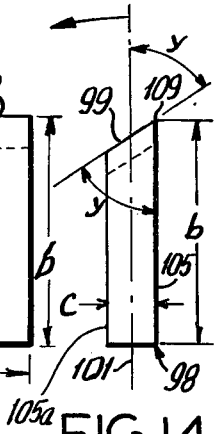
FIG. 14 is a side view of FIG. 13 showing the clearance angle of the cutter.

FIG. 12 illustrates a preferred embodiment of cutter 98 with a single beveling notch 108 formed at cutting side 106. The commonly used notch half angle X is approximately 55° and the preferred notch depth d is 0.38 mm. The preferred cutter width a is approximately 0.75 mm. The preferred cutter depth b is approximately 0.5 mm, and the preferred thickness c as illustrated in FIG. 14, is approximately 0.07 mm. FIG. 13 illustrates another preferred embodiment with three beveling notches 107, 108 and 109 being provided in cutter 98.

FIG. 14 illustrates a side view of both FIGS. 12 and 13. As shown, cutter 98 has cutting face 99 and radial plane of rotation 101. The angle y formed between cutting face 99 and plane of rotation 101 is approximately 65°. Angle y, the clearance angle, is critical to the operation of machine 10. Particles formed during the lens cutting process tend to move along the face of stroke side 105*a* of the cutter and to accumulate, thus interfering in the cutting process. When clearance angle y is formed, the cut particles are directed away from the stroke side and from the radial plane of rotation, and the actual angle of approximately 65° is found by usage to be critical. Thus cutting face 99 is formed and intersects cutter trailing side 105 and cutter stroke side 105*a*. Cutting edge 109 is formed at the intersection of cutting face 99 and trailing side 105, as indicated by the rotational arrow. That is, although stroke side 107 approaches the lens first, the actual cutting occurs at cutting edge 109.

Figure 8:
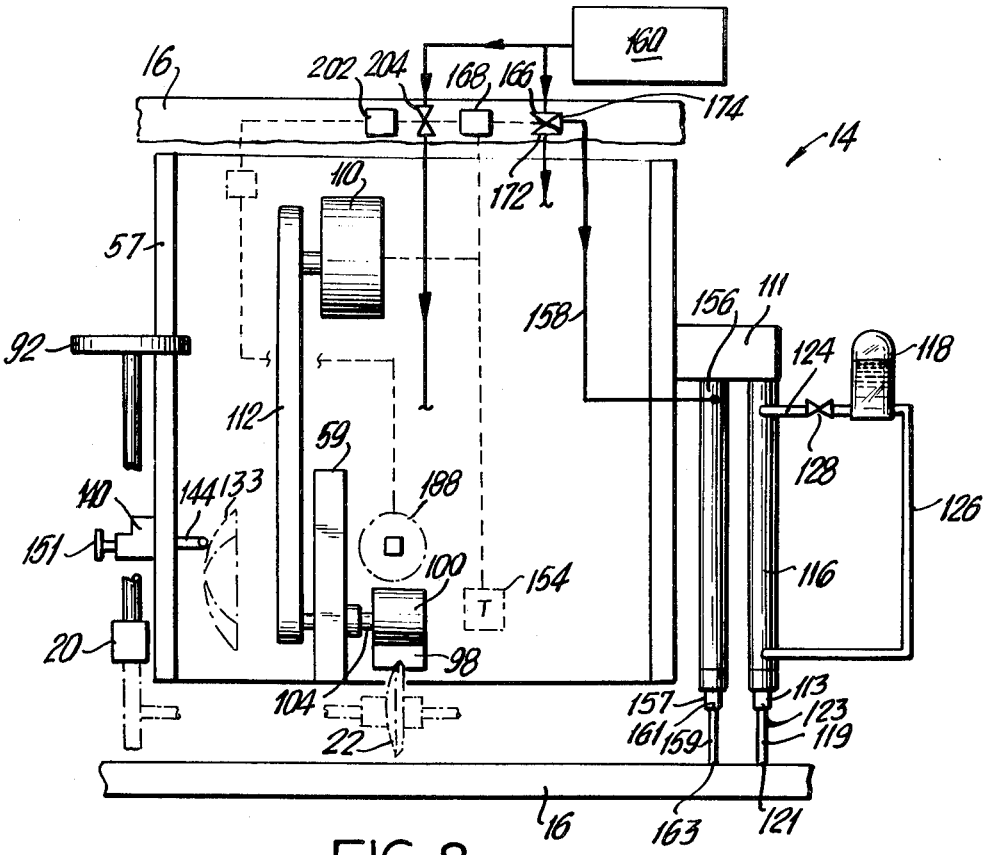
FIG. 8 is a schematic view of the carriage of the subject invention including essential features and selected head elements in imaginary lines.

In accordance with the subject invention, the downward movement of carriage 14 from its rear upper position to its forward lower position (and thus of the movement of pattern follower 82 against lens pattern cam 20 and of cutter 98 against lens periphery 23) is dampened to an optimum speed and pressure by hydraulic dampening means mounted on carriage 14 and connected to base 16. The dampening means is thus capable of regulating the gravitational movement of carriage 14 toward pattern/lens axis 24 and of regulating the engagement of the cutting edge of cutter 98 with periphery 23 of lens 22. The hydraulic means includes hydraulic cylinder 116 affixed to carriage 16 via connecting bar 111 and right vertical mounting member 59, piston 113 slidably mounted within hydraulic cylinder 116, and piston rod 119 having opposed ends 121 and 123, end 121 being affixed to base 16 and end 123 being connected to piston 113. Thus, hydraulic cylinder 116 is capable of movement relative to rod 119 and base 16. Reservoir 118, preferably containing a hydraulic oil, has input piping 124 to cylinder 116 and output piping 126 from cylinder 116, as illustrated in FIGS. 4 and 8. Manual control valve 128 on the input piping side regulates the rate of flow of the hydraulic liquid and thus of the rate of descent of the carriage.

Lens 22 has the curvature 25 noted earlier when prescription lenses are being edged. At times no curvature is present on the lens, generally in the case of non-prescription sunglasses. Lenses can be classified according to the actual radius of the particular lens in millimeters. A common range is 0 through 10. A "0" designation indicates a flat lens, a "1" designation indicates a base curvature of 1 millimeter, a "2" designation indicates a base curve of 2 millimeters, and so on. Lens 22 as illustrated in the drawings possesses a base curve 130 of indeterminate number, including "0." Base curve 130 is illustrated facing left relative to the frontal view as a preferred embodiment because of the placement of other mechanisms on the head and carriage, but the subject invention could be arranged differently without effect upon its inventive qualities.

Figure 5:
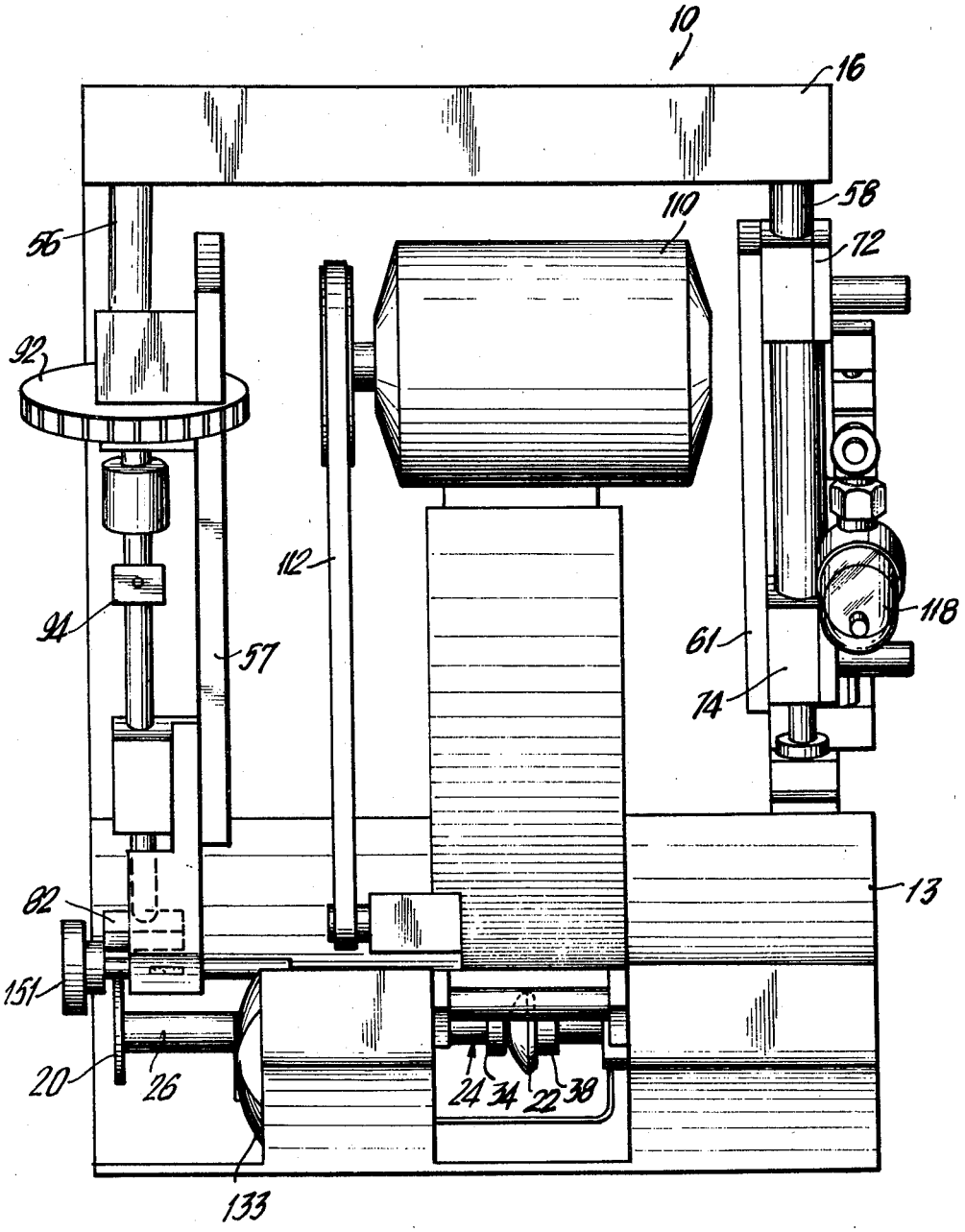
FIG. 5 is a top plan view of the subject invention.
Figure 9:
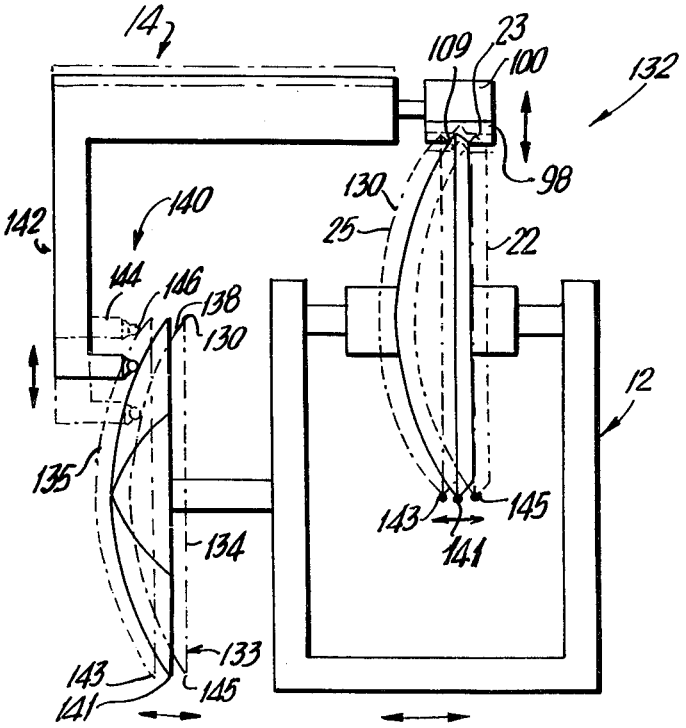
FIG. 9 is a schematic view of the operation of the cutter beveling aligning means of the subject invention.
Figure 16:
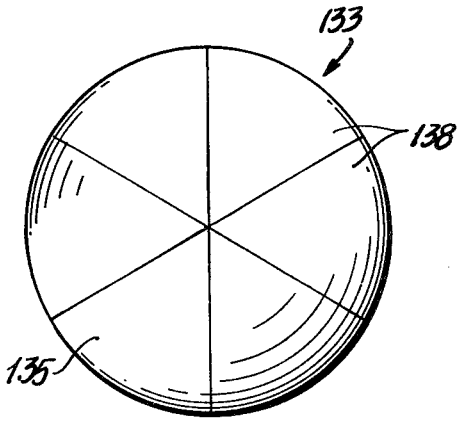
FIG. 16 is an isolated top view of the base curve cam of the subject invention.

In accordance with the subject invention, bevel aligning means 132 is illustrated in FIGS. 7, 8, and most notably in schematic FIG. 9. The bevel aligning means includes base curve cam means 133 connected to head 12 (at vertical support plate 136 as shown in FIG. 2), which is affixed to left vertical frame 32 by bridge 137. Cam 133 is of a circular shape with one flat surface 134 and one curved surface 135. Curved surface 135 has formed upon it a plurality of discrete curved surface sectors 138, shown in top view in FIG. 16. Each sector 138 is of equal area and is formed by radii emanating from the center of surface 135. Each sector 138 has a distinctive base curvature configuration. Cam 133 is removable and replaceable with another cam. A common cam would have a plurality of base curve sectors commonly encountered as related to the base curve of lenses selected to be edged and beveled. Such a group could be, for example, sectors 138 with base curve radii of 4, 5, 6, 7, 8, and 9, or a total of six sectors. For purposes of illustration, cam 133 is shown as having six sectors, but in fact represent no particular base curves. Cam 133 is rotatably mounted to plate 136, as shown in FIGS. 2, 5, and 7.

In accordance with the subject invention, bevel aligning means 132 also includes cam tracing means 140 connected to carriage 14 via mounting member 142, which in turn is affixed to carriage vertical mounting member 57. Tracing means 140 includes finger 144 affixed to mounting member 142 at one end and has steel ball tracing tip 146 at the opposite end. Tracing tip 146 is capable of being in bearing contact with the surface of one of the plurality of discrete sectors 138 of base curve cam 133. Tracing tip 146 is preferably a steel ball rotatably encased by finger 144, but other constructions are possible within the spirit of the subject invention. Rotation of cam 133 brings one sector 138 at a time into alignment with tracer 140. Tracing means 140 is capable of being in bearing contact with any one sector of cam 133 and of effecting a lateral movement of head 12 in a first direction to a position that aligns the center of periphery 23 of lens 22 with cutter beveling means 108. The beveling means is thus capable of being in bearing contact with the center of the lens periphery when carriage 14 is bearing downwards by gravitational force, carrying the cutter with it. FIG. 9 illustrates an initial position 141, a left position 143, indicated by dotted lines, and a right position 145, also indicated by dotted lines, showing the shifting of lens 22 to the left and right as the aligning means 140 rises and falls, which is in accordance with a combining of the pattern follower and the base curve transcription by finger 142.

In accordance with the subject invention, biasing means, preferably expansion spring 150 connected to head 12 and base member 16 as schematically illustrated in FIG. 7, effects a movement of head 12 in a second direction opposite to the first direction noted above, resulting in bearing contact of one of the plurality of sectors 138 of surface 135 of cam 133 against tracing tip 146 of tracing means 140.

In accordance with the subject invention, when lens 22 is rotated by motor 48, and cutter 98 is rotated at high speed by motor 110, cutter 98 cuts and edges lens periphery 23 and beveling means 109 simultaneously forms the crown of the bevel at the center of the periphery of the lens, or, as will be discussed, at any position on the periphery of the lens selected by the operator. That is, as pattern 20 rotates, carriage 14 floats up and down in accordance with the reaction of pattern follower 54 as it follows the pattern, thus causing cutter 98 to float in the same manner as it contours the lens. As noted above, the overall dimensions of the lens can be adjusted via major sizing adjuster 92 and minor sizing controller 96.

In accordance with the subject invention, base curve cam means 133 is manually rotatable so that each of the base curve sectors 138 is capable of being positioned to receive the bearing pressure of tracing finger 144. Thus, cam means 133 is capable of being positioned so as to align the center of lens periphery 23 with beveling crown means 109 according to the base curvature of the lens selected to be cut without having to replace base curve cam 133 as mounted with a new base curve cam to match the new lens. Of course, cam 133 as mounted must have a sector 138 with a base curve that matches the base curvature of the new lens. If, for example, base curve cam 133 has base curve sector with base curves 4 through 9 and the lens curvature is 8, the cam is rotated until the sector having a base curvature of 8 is in bearing contact with finger 144. In the event, for example, a lens of base curvature 10 is selected for production, the operator must remove cam 133 and replace it with a new cam 133 containing a base curve of 10. In addition, a specialty molded cam with odd base curve sizes, such as 5.3, 5.4, and so on, could be used.

In accordance with the present invention, a bevel adjustment can be made as to where the crown of the bevel is to fall on lens periphery 23. Bevel adjuster 151 (shown in FIGS. 2 and 8) can be manually operated to shift finger 144 toward head 12 and cam 133, which would shift the crown of the bevel towards the front of lens 22, or operated to shift finger 144 away from cam 133, which would shift the crown of the bevel towards the rear of lens 22. Bevel indicator 152 (shown in FIGS. 1 and 2) shows at what point the bevel will fall. There is always a point that is always the midpoint of the periphery of the lens at which the crown of the bevel will fall, with additional plus and minus markings on indicator 152 showing direction towards the front of the lens or towards the rear of the lens, and the exact distance, such as, for example, $\frac{1}{3}$, $\frac{2}{3}$, and so on, of the distance front or towards the rear of the lens.

When cutter 98 has completed its edging and beveling operation, a timing means, preferably rotating timer cam 154 (FIG. 7) having a switch means and mounted on head 12 sends three simultaneous control signals, one to turn off main motor 110, one to turn off pattern and lens motor 48, and a third to pressurized air carriage return means for sending carriage 14 up and away from head 12 and cutter 98 away from lens periphery 23.

In accordance with the subject invention, carriage return means includes air cylinder 156 affixed to carriage 14 at right vertical mounting member 59 via connecting bar 111, which is affixed to right vertical mounting member 59, piston 157 slidably mounted within cylinder 156, and piston rod 159. Rod 159 has opposed ends 161 and 163, end 161 being affixed to base 16 and end 163 being connected to piston 157. Air cylinder 156 is thus capable of movement relative to rod 159 and base 16 and thus is capable of moving carriage 14 relative to base 16. Pressurized air transfer means, preferably pressurized air tube 158 which leads to an outside source of pressurized air such as compressor 160 outside of machine 10. Tube 158 preferably acts as both inlet and outlet for the pressurized air as illustrated in schematic FIG. 8. Three way valve 166 mounted on base 16 is operated by solenoid 168 also mounted on base 16. Solenoid 168 is controlled by a signal from timer cam 154, mounted on head 12.

When carriage 14 is at its top position away from head 12, it is held in place by pressurized air contained in air cylinder 156 from compressor 160 sent to the cylinder via three way valve 166. Exhaust side 172 of valve 166 is closed and inlet side 174 is open during the time solenoid 168 is being activated by timer cam 154. This valve position allows compressed air from the compressor to enter the air cylinder 156 by the force of pressure against piston 157 causing cylinder 156 to move away from base 16 thus moving carriage 14 away from base 12.

Figure 15:
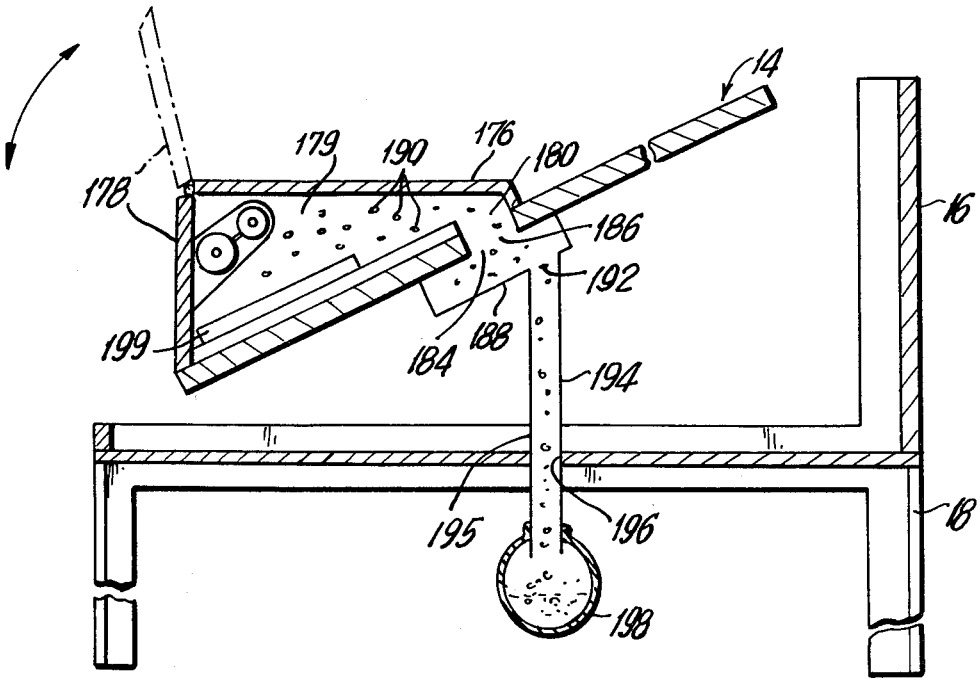
FIG. 15 is an isolated schematic side view illustrating the shroud and the plastic particle evacuating means of the subject invention.

As illustrated in FIGS. 8 and 15, shroud 176 mounted on carriage 14 has door 178 preferably attached to the top front of the shroud by hinges. When the door is closed, the shroud forms substantially sealed enclosure 179 with the exception of shroud exit 180 at the rear of the shroud. Exit 100 leads through carriage aperture 184 to inlet side 186 of fan 188, which is affixed to carriage 14, preferably under the carriage as illustrated. When the cutter is operating, plastic dust particles 190 from the lens are drawn from the shroud enclosure by suction of vacuum action created by operation of fan 188 through fan inlet 186 and ejected from fan outlet 192 and through hose 194, which is removably connected to the fan outlet and which passes through base aperture 195, table aperture 196 and into receptacle 198. Heavier plastic particles too large to be evacuated by vacuum action fall from the lens onto tray 199 placed on the bottom of shroud 176. When the tray is full it may be removed and cleaned.

Operation of chuck fan rocker switch 160 causes either a simultaneous signal for startup of fan 188 and activation of chuck pressurized air cylinder solenoid 202 or alternatively a signal for shutdown of fan 188 and deactivation of solenoid 202, depending on whether the lens cutting operation is starting or terminating. Chuck solenoid 202 operates chuck air cylinder valve 204, which is connected to compressor 160. Both solenoid 202 and valve 204 are preferably mounted upon the rear portion of base 16.

When carriage door 178 is opened, a switch is activated that sends a shutdown signal to cutter motor 110 and lens motor 48 and in addition a third signal is sent activating carriage return air cylinder solenoid 168. This is a safety feature that protects the operator from injury from plastic particles in the event door 178 is inadvertently opened.

In summary there is provided a new and improved machine for cutting, edging, contouring, and beveling the periphery of a plastic lens. More particularly, a cutter is provided having a cutting edge of a high hardness and being capable of being rotated at high speed and being self-cooled by the movement of air created by its own rotation. Also provided is a hydraulic dampening means mounted on the carriage and connected to the base capable of regulating the gravitational movement of the carriage toward the axis of rotation of the lens and of regulating the engagement of the cutter with the periphery of the lens. In addition, a bevel aligning means is provided having a base curve cam means connected to the head and cam tracing means connected to the carriage. The cam means has a surface forming the same base curvature as the lens, the tracing means being capable of being in bearing contact with the cam surface and of effecting movement of the head in a first direction that aligns the center of or any selected position on the lens with the beveling means. The aligning means includes biasing means connected to the head and to the base and effecting a movement of the head in a second direction resulting in bearing contact of the cam surface against the tracing means. When the lens and the lens pattern are rotated and the cutter is rotated at high speed, the cutter edges and bevels the lens and the beveling means simultaneously forms a bevel at the center of the periphery of the lens. The new and improved lens edging and beveling machine of the subject invention eliminates the need for liquid cooling of the lens. The new and improved machine also provides a means for automatically aligning the crown of the bevel to a selected position around the periphery of the lens.

Although the invention has been described in connection with a preferred embodiment, it will be apparent to those skilled in the art that additions, modifications, and substitutions may be made without departing from the spirit and scope of the subject invention as defined by the appended claims.

What is claimed is:

1. An improved machine for cutting, edging, contouring, and beveling the periphery of a plastic lens, said machine being of the type having a head mounted on a base and carrying a lens pattern and a plastic lens which is to be cut and has a base curvature, means for rotating said pattern and said lens about a common axis, wherein the machine includes a carriage mounted on said base and having a pattern follower in bearing contact with said pattern and having a rotatable cutter with a cutting edge capable of engaging said periphery of said lens, said cutting edge forming a beveling means, means for moving said carriage substantially perpendicular toward and away from said axis, said movement effecting an engagement of said cutter with said periphery of said lens, the improvement comprising:

said cutter having a cutter edge of a metal of a high hardness and rotatable at high speed, said cutter having a cutting face and a radial plane of rotation, said cutting face forming a clearance angle with said radial plane, said face operative to direct particles along said face away from said radial plane of rotation; and bevel aligning means including base curve cam means connected to said head and cam tracing means connected to said carriage, said cam means having a surface forming the same base curvature as said lens, said tracing means being in bearing contact with said surface for effecting a movement of said head with said lens in a first direction to a position that aligns the center of said lens with said beveling means, said aligning means including biasing means connected to said head and said base and effecting a movement of said head in a second direction resulting in bearing contact of said surface of said cam means against said tracing means, said surface of said base curve cam means including a plurality of discrete sectors, each of said sectors having a different base curvature surface, said cam means rotatable to effect bearing alignment between the surface of any selected sector and said tracing means, whereby when said selected sector has a surface forming the same base curvature as the base curvature of said lens, said tracing means effects a movement of said head with said lens in said first direction to a position that aligns the center of said lens with said beveling means, whereby when said lens and said lens pattern are rotated and said cutter is rotated at high speed, said carriage moves toward said axis effecting an engagement of said cutter with said lens periphery to cut and edge said plastic lens and simultaneously form a bevel at the center of said periphery.

2. An improved machine for cutting plastic lenses as recited in claim 1 wherein said carriage is movable towards said axis by gravitational force, and wherein said machine includes hydraulic dampening means mounted on said carriage connected to said base, said dampening means regulating said gravitational movement of said carriage toward said axis and regulating the engagement of said cutter with the periphery of said plastic lens.

3. An improved machine for cutting plastic lenses as recited in claim 1, further including pressurized air carriage return means mounted on said carriage and connected to said base, said pressurized air means operative to return said carriage away from said axis and said cutter away from said engagement with the periphery of said lens.

4. An improved machine for cutting plastic lenses as recited in claim 3, wherein said pressurized carriage return air means includes a pressurized air cylinder affixed to said carriage, a piston slidably mounted within said air cylinder, and a piston rod having opposed ends, one end being connected to said base and the other end being connected to said piston, said cylinder movable relative to said rod and said base.

5. An improved machine for cutting plastic lenses as recited in claim 4 wherein said pressurized air means further includes pressurized air means for effecting the movement of said cylinder relative to said rod and said base.

6. An improved machine for cutting plastic lenses as recited in claim 1, wherein said cutting edge forms a plurality of beveling means.

7. An improved machine for cutting lenses as recited in claim 1 wherein said cutting face forms a clearance angle of approximately 65° with said radius of rotation.

8. An improved machine for cutting plastic lenses as recited in claim 1, further including adjustment means for effecting measured lateral adjustment of said cam tracing means parallel to said common axis, said adjustment means moving said tracing means in a direction nearer to said base curve cam or in a direction away from said base curve cam, said movements effecting measured alignment of said periphery of said lens with said beveling means either toward the front or toward the back of said lens, whereby when said lens and said cutter are rotated and said cutter engages said lens periphery, said beveling means forms a bevel on said periphery at a selected lateral position.

9. An improved machine for cutting plastic lenses as recited in claim 2, wherein said hydraulic dampening means includes a hydraulic cylinder affixed to said carriage, a piston slidably mounted within said hydraulic cylinder, and a piston rod having opposed ends, one end being connected to said base and the other end being connected to said piston, said hydraulic cylinder movable relative to said rod and said base.

10. An improved machine for cutting plastic lenses as recited in claim 9, wherein said hydraulic means further includes a hydraulic fluid means for effecting the movement of said cylinder.

11. An improved machine for cutting plastic lenses as recited in claim 1 further including a particle evacuating means capable of removing plastic dust particles from the area of the lens during cutting operation, said means including a substantially sealed enclosure mounted on said carriage and surrounding said lens and said cutter, said enclosure forming an aperture, a fan affixed to said carriage, said fan having an inlet opening and an outlet opening, said inlet opening being coextensive with said aperture, and a receptacle means for receiving said particles connected to said outlet opening, whereby when said lens is being cut and said fan is operating, a vacuum is created in said enclosure and said plastic dust particles are drawn from said enclosure through said fan and into said receptacle means.

12. An improved machine for cutting plastic lenses as in claim 11 wherein said particle evacuating means is disposed immediately below said cutter.

* * * * *